US007278821B1

(12) United States Patent
O'Reilly et al.

(10) Patent No.: US 7,278,821 B1
(45) Date of Patent: Oct. 9, 2007

(54) METHODS AND APPARATUS FOR ASSEMBLING GAS TURBINE ENGINES

(75) Inventors: Daniel Padraic O'Reilly, Hamilton, OH (US); Ronald Lance Galley, Mason, OH (US)

(73) Assignee: General Electric Company, Schenectady, NY (US)

( * ) Notice: Subject to any disclaimer, the term of this patent is extended or adjusted under 35 U.S.C. 154(b) by 307 days.

(21) Appl. No.: 10/982,050

(22) Filed: Nov. 4, 2004

(51) Int. Cl.
*F01D 1/02* (2006.01)

(52) U.S. Cl. ..... 415/189; 415/196; 415/208.2; 29/889.21

(58) Field of Classification Search ..... 415/144, 415/145, 170.1, 173.1, 189, 190–191, 196, 415/208.2, 209.2, 209.3, 209.4; 29/281.1, 29/559, 889.21, 889.22; 228/182
See application file for complete search history.

(56) References Cited

U.S. PATENT DOCUMENTS

| | | | | |
|---|---|---|---|---|
| 2,945,290 | A * | 7/1960 | Walsh | 29/889.22 |
| 3,072,381 | A * | 1/1963 | Lameris | 415/209.4 |
| 4,155,680 | A * | 5/1979 | Linko et al. | 415/144 |
| 4,270,256 | A * | 6/1981 | Ewing | 29/889.21 |
| 5,182,855 | A * | 2/1993 | Martin | 29/889.22 |
| 5,188,507 | A * | 2/1993 | Sweeney | 415/173.1 |
| 5,192,185 | A * | 3/1993 | Leonard | 415/170.1 |
| 5,333,995 | A * | 8/1994 | Jacobs et al. | 415/209.2 |
| 6,179,557 | B1 * | 1/2001 | Dodd et al. | 415/173.1 |
| 6,609,880 | B2 | 8/2003 | Powis et al. | |
| 6,729,842 | B2 | 5/2004 | Drerup et al. | |
| 6,808,364 | B2 | 10/2004 | O'Reilly et al. | |
| 2003/0057263 | A1 * | 3/2003 | Beedon et al. | 228/182 |

* cited by examiner

*Primary Examiner*—Igor Kershteyn
(74) *Attorney, Agent, or Firm*—William Scott Andes Armstrong Teasdale LLP

(57) ABSTRACT

A gas turbine engine compressor including a stator assembly and a method of assembling the same are provided. The method includes providing a compressor casing including at least two stator vane casing rails extending from the casing, coupling a rail liner within each respective casing rail, and coupling a stator vane assembly including two dovetails, and at least two stator vanes coupled together within the casing rails within the liner such that a first dovetail is received within a first casing rail and a first rail liner, and a second dovetail is received within a second casing rail and a second rail liner.

18 Claims, 4 Drawing Sheets

METHODS AND APPARATUS FOR ASSEMBLING GAS TURBINE ENGINES

BACKGROUND OF THE INVENTION

This invention relates generally to gas turbine engines, and more particularly, to methods and apparatus for assembling gas turbine engine compressors.

At least some known gas turbine engines include, in serial flow arrangement, a compressor, a combustor, a high pressure turbine, and a low pressure turbine. The compressor, combustor and high pressure turbine are sometimes collectively referred to as the core engine. Compressed air is channeled from the compressor to the combustor where it is mixed with fuel and ignited. The combustion gasses are channeled to the turbines which extract energy from the combustion gasses to power the compressors and to produce useful work to propel an aircraft in flight or to power a load, such as an electrical generator.

Known compressors include a rotor assembly and a stator assembly. Known rotor assemblies include a plurality of rows of circumferentially-spaced rotor blades that extend radially outward from a shaft or disk. Known stator assemblies may include a plurality of stator vanes which extend circumferentially between adjacent rows of rotor blades to form a nozzle for directing air passing therethrough towards downstream rotor blades. More specifically, known stator vanes extend radially inward from a compressor casing between adjacent rows of rotor blades.

In at least some compressors, each stator vane is unitarily formed with an airfoil and platform that are mounted through an integrally-formed dovetail to the compressor casing. To facilitate assembly of the stator vanes to the casing, a small amount of clearance is permitted between a casing dovetail or vane rail and the vane platform. However, the clearance enables a small degree of relative motion between the vane platform and the casing vane rail. Over time, continued movement between the stator vanes and the casing rail may cause vane platform and/or casing wear. Such relative movement of the stator vanes may be enhanced by vibrations generated during engine operation.

To facilitate reducing wear between the casing and vane platform, at least some stator assemblies are coated with wear coatings or lubricants. Other known compressors use casing rail liners, and/or vane springs to facilitate reducing such wear. However, known wear coatings may not be useful in some single vane applications, and known vane springs may not be suitable for use with vanes that include air bleed holes. Moreover, known rail liners are only useful in a limited number of engine designs.

BRIEF DESCRIPTION OF THE INVENTION

In one aspect, a method for assembling a gas turbine engine compressor is provided. The method includes providing a compressor casing including at least one stator vane casing rail extending from the casing, coupling a rail liner to the casing rail, and coupling a stator vane assembly including at least two stator vanes coupled together to the casing rail within the liner.

In another aspect, a stator vane assembly for a gas turbine engine is provided that includes a plurality of circumferentially-spaced stator vane doublets. Each doublet includes a pair of stator vanes coupled together at a respective outer stator vane platform of each vane. Each stator vane platform is configured to slidably couple each doublet to a vane rail extending from a compressor casing that extends at least partially circumferentially around the stator vane assembly.

In another aspect, a compressor for a gas turbine engine is provided. The compressor includes a casing including a plurality of stator vane rails. The casing defines an axial flow path for the compressor. A rotor is positioned within the flow path. The rotor includes a plurality of rows of circumferentially-spaced rotor blades. A stator vane assembly extends between adjacent rows of the plurality of rows of rotor blades. Each stator vane assembly includes a plurality of circumferentially-spaced stator vane doublets received within the vane rail. Each stator vane doublet includes a pair of stator vanes coupled together at a respective outer stator vane platform of each vane.

DETAILED DESCRIPTION OF THE INVENTION

Figure 1:
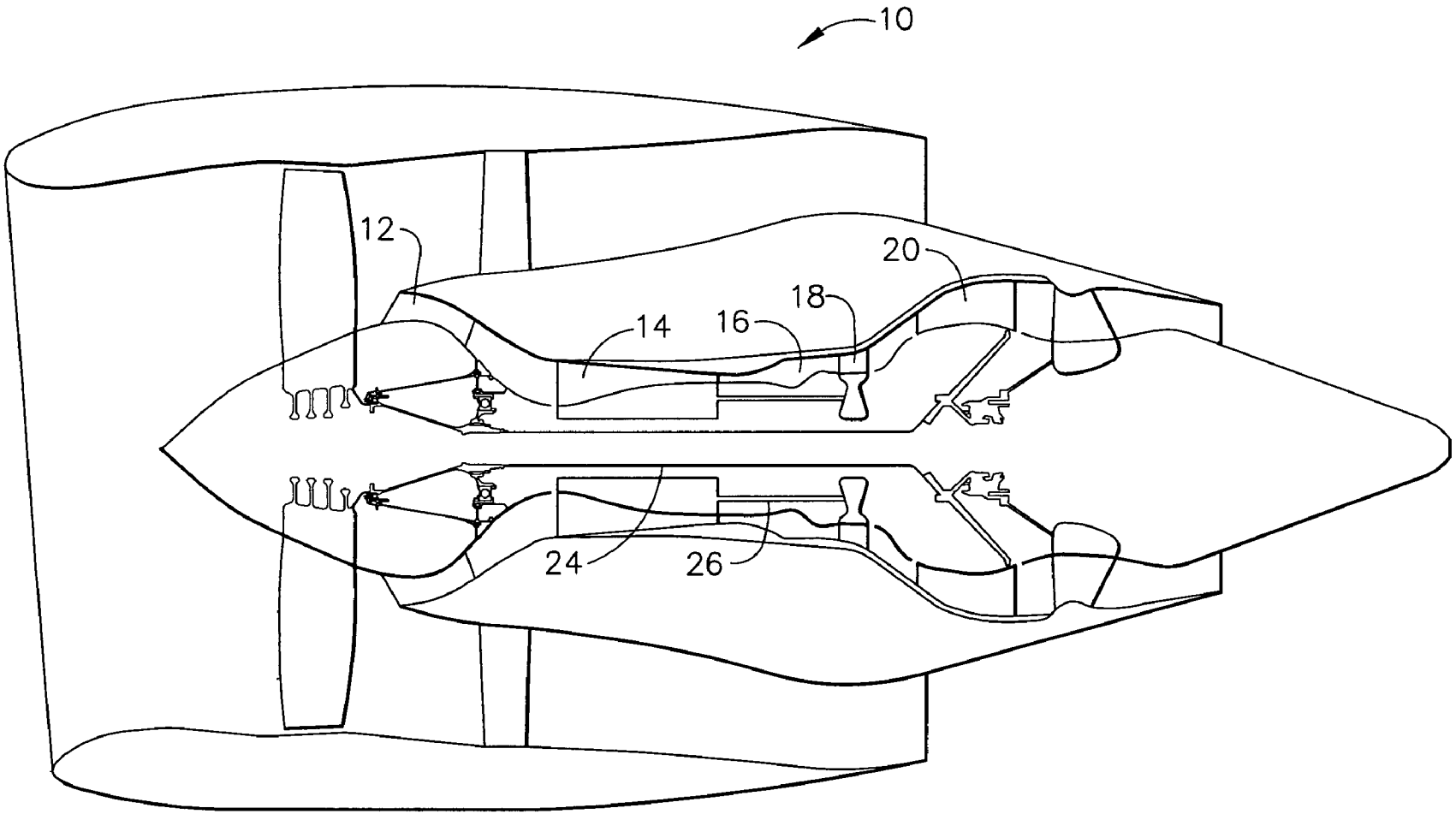
FIG. 1 is a schematic illustration of a gas turbine engine.

FIG. 1 is a schematic illustration of a gas turbine engine 10 including a low pressure compressor 12, a high pressure compressor 14, and a combustor 16 that defines a combustion chamber (not shown). Engine 10 also includes a high pressure turbine 18, and a low pressure turbine 20. Compressor 12 and turbine 20 are coupled by a first rotor shaft 24, and compressor 14 and turbine 18 are coupled by a second rotor shaft 26. In one embodiment, engine 10 is a CF6 engine available from General Electric Aircraft Engines, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives rotating turbines 18 and 20.

Figure 2:
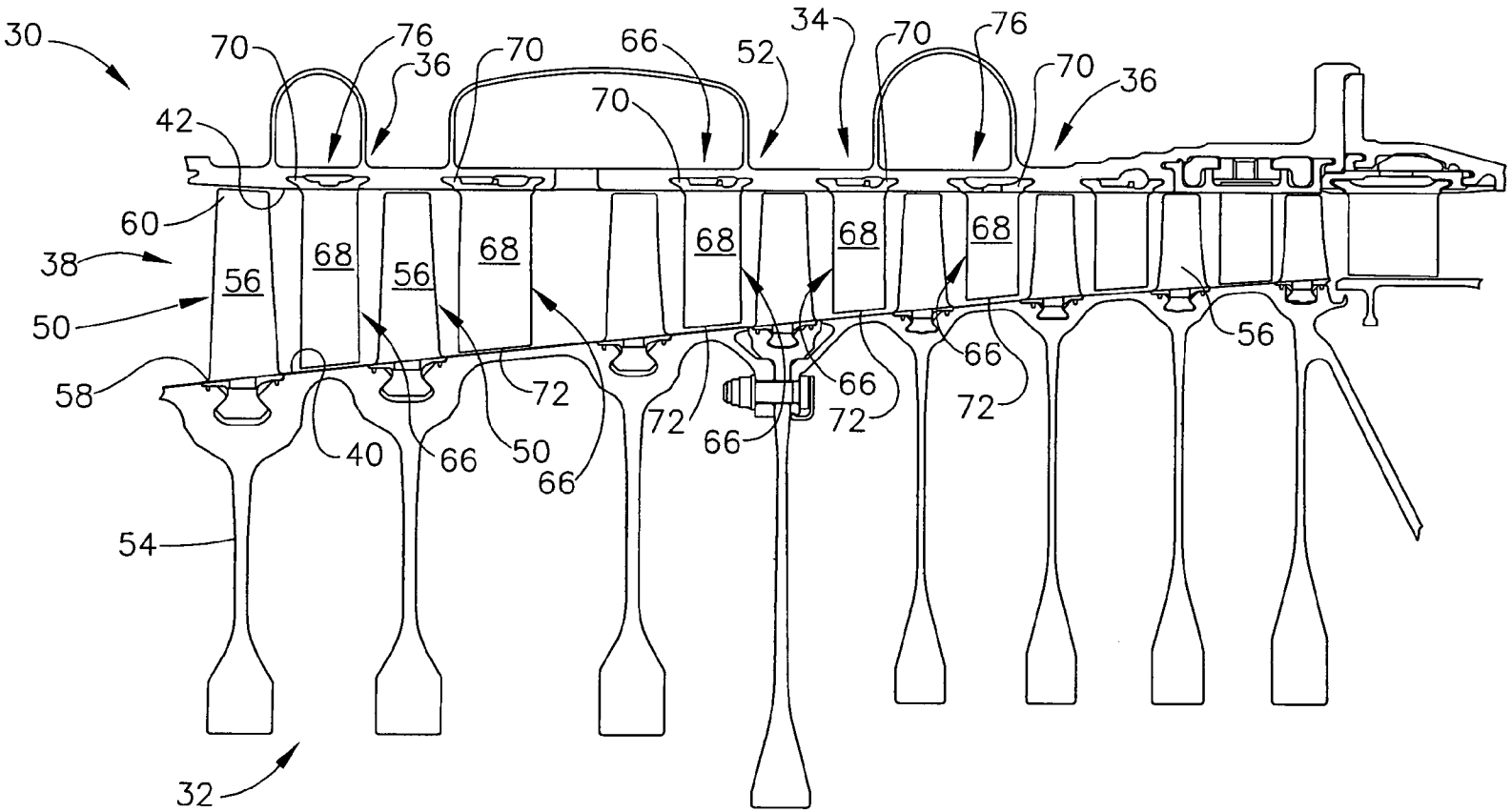
FIG. 2 is a cross sectional view of a compressor suitable for use with the engine shown in FIG. 1.
Figure 3:
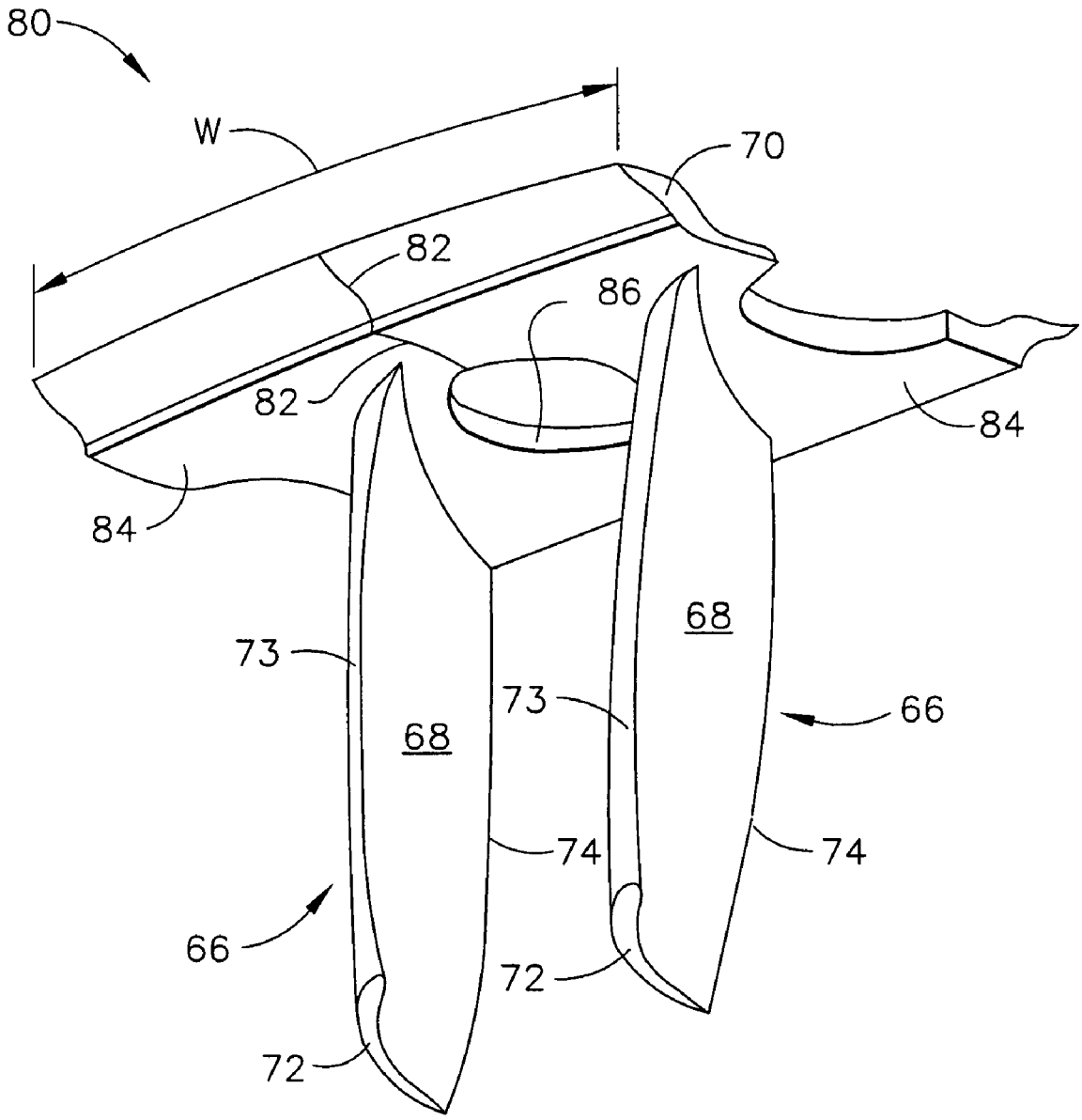
FIG. 3 is a perspective view of an exemplary stator vane doublet suitable for use in the compressor shown in FIG. 2.

FIG. 2 is a cross-sectional illustration of a portion of a compressor 30 that may be used with gas turbine engine 10. FIG. 3 illustrates an exemplary stator vane doublet 80. In an exemplary embodiment, compressor 30 is a high pressure compressor. Compressor 30 includes a rotor assembly 32 and a stator assembly 34 that are positioned within a casing 36 that defines a flowpath 38. The rotor assembly 32 defines an inner flowpath boundary 40 of the flowpath 38. Stator assembly 34 defines an outer flowpath boundary 42 of flowpath 38. Compressor 30 includes a plurality of stages with each stage including a row of circumferentially-spaced rotor blades 50 and a row of stator vane assemblies 52. In an exemplary embodiment, rotor blades 50 are coupled to a rotor disk 54. Specifically, each rotor blade 50 extends radially outwardly from rotor disk 54 and includes an airfoil 56 that extends radially from an inner blade platform 58 to a blade tip 60.

Stator assembly 34 includes a plurality of rows of stator vane assemblies 52 with each row of vane assemblies 52 positioned between adjacent rows of rotor blades 50. The compressor stages are configured for cooperating with a motive or working fluid, such as air, such that the motive fluid is compressed in succeeding stages. Each row of vane assemblies 52 includes a plurality of circumferentially-spaced stator vanes 66 that each extends radially inward from casing 36 and includes an airfoil 68 that extends from an outer vane platform 70 to a vane tip 72. Airfoil 68 includes a leading edge 73 and a trailing edge 74. In an exemplary embodiment, stator vanes 66 have no inner platform. Compressor 30 includes one stator vane row per stage, some of which are bleed stages 76.

At bleed stages 76, vane assembly 52 includes a plurality of circumferentially-spaced stator vane doublets 80. As shown in FIG. 3, stator vane doublet 80 includes a pair of stator vanes 66 joined at abutting edges 82 of their respective outer stator vane platforms 70 to form a vane segment. The joined platforms 70 are configured to be received in a vane rail 88 formed in compressor casing 36 as will be described. The stator vane doublet 80 includes two airfoils 68 joined together through a brazing process and has a circumferential width W. In an exemplary embodiment, stator vanes 66 are joined by a gold-nickel braze material. Each stator vane platform 70 includes an inwardly facing surface 84 that defines a portion of outer flowpath boundary 42 in compressor 30. At bleed stage 76, stator vane doublet 80 includes a bleed hole 86 formed in the joined vane platforms 70 between airfoils 68. Bleed holes 86 bleed off a portion of the motive fluid for use in cooling one or more stages of HP turbine 18.

Figure 4:
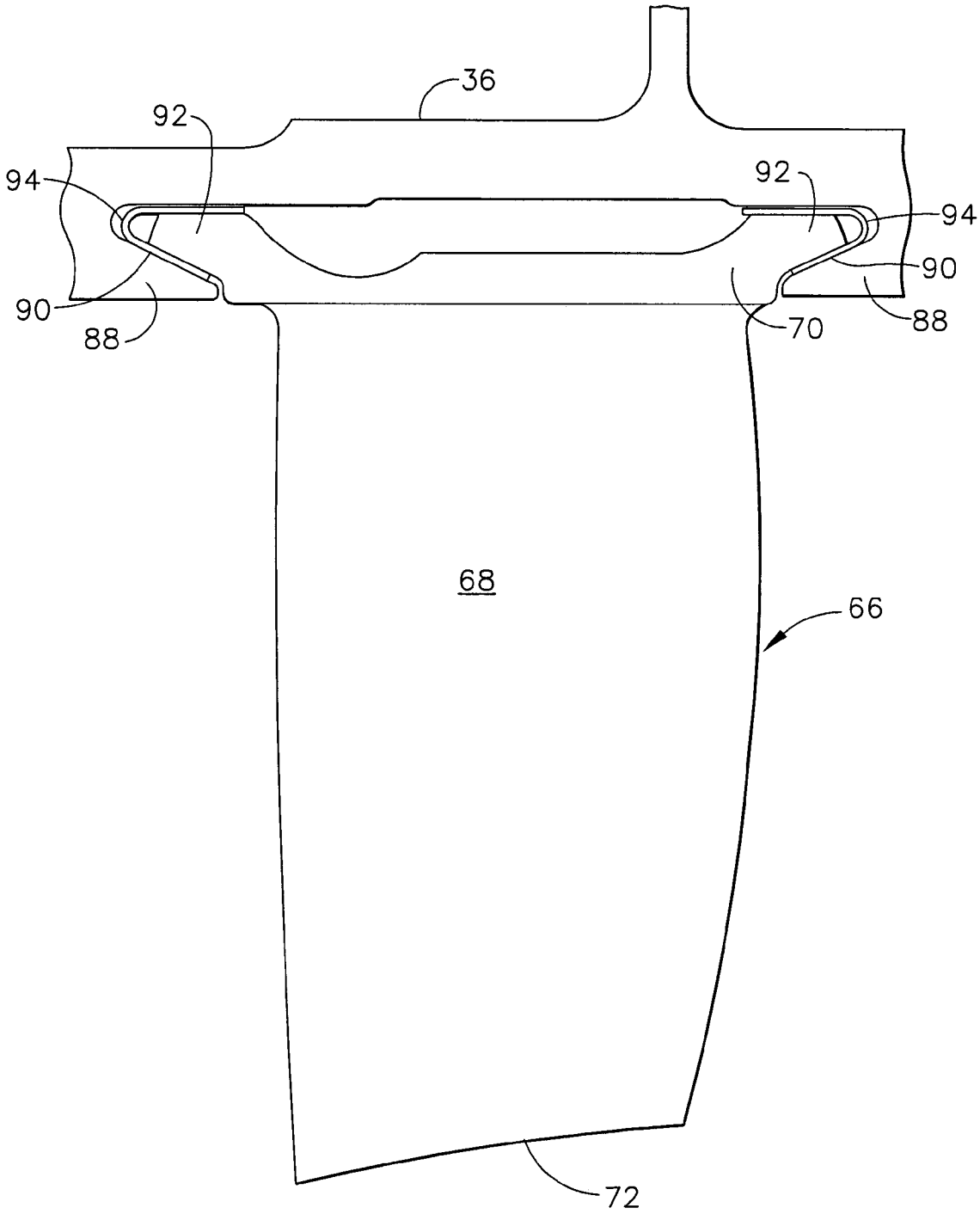
FIG. 4 is a cross sectional view of the stator vane doublet shown in FIG. 3 mounted in a compressor casing.

FIG. 4 illustrates a cross sectional view of stator vane doublet 80 mounted within casing 36. Casing 36 includes casing vane rails 88 that each includes a vane platform engagement surface 90. Stator vane platform 70 includes dovetails 92 that are received in casing vane rails 88. In an exemplary embodiment, a vane rail liner 94 is mounted within casing vane rails 88 and stator vane doublets 80 are received within vane rail liner 94. Vane rail liner 94 provides a sacrificial wear surface between casing vane rails 88 and stator vane platform dovetails 92.

In operation, stator vane doublet 80 provides a vane segment that has a circumferential width W that is sufficiently large to substantially reduce a range of relative movement between stator vane platforms 70 of stator vanes 66 and casing vane rails 88. The reduced allowable movement reduces an amount of wear experienced between casing vane rails 88 and stator vane platforms 70. In an exemplary embodiment, vane rail liner 94 and stator vane doublet 80 cooperate to further reduce the range of relative movement between stator vane doublet 80 and casing vane rail 88. Vibration from the coupled stator vane airfoils 68 partially cancel each other so that with stator vane doublet 80, vibration transmitted to joined platforms 70 is reduced.

Stator vanes 66 are joined to form vane doublets 80. In forming vane doublets 80, at least a portion of abutting edges 82 of stator vane platforms 70 of stator vanes 66 is first nickel-plated. The stator vanes 66 are then mounted in a precision tack welding fixture (not shown) that has a curvature substantially corresponding to a curvature of casing vane rail 88 and tack welded. The tack welded stator vanes 66 are then placed in a carbon member (not shown) to hold the desired shape during the braze furnace cycle. The tack welded stator vanes 66 are then brazed along outer vane platforms 70 using a gold-nickel braze alloy to form stator vane doublet 80. The gold-nickel braze provides ductility and temperature stability in the braze joint necessary for durability of the joint during engine operation. After brazing, the stator vane doublet 80 is re-aged in the carbon member to restore metallurgical properties.

Assembly of vane doublet 80 into compressor casing 36 is accomplished by mounting a casing vane rail liner 94 on casing vane rail 88 and mounting vane doublet 80 within vane rail liner 94. The extended platform length of vane doublet 80 together with casing vane rail liner 88 take up excess clearance in casing vane rail 88 which facilitates reducing a vibration response of vane doublet 80 with respect to individual vanes 66.

The above described compressor assembly provides a cost effective and reliable means for reducing stator vane platform to casing vane rail wear. More specifically, the compressor assembly employs stator vane doublets at the compressor bleed stages. The stator vane doublets provide vane segment that have a circumferential width that is sufficiently large to substantially reduce the amount of allowable movement between stator vane platforms and the casing vane rails. The reduced allowable movement reduces the amount of wear experienced between the casing vane rails and the stator vane platforms. A vane rail liner further reduces movement between the stator vane doublet and casing vane rail and provides a sacrificial surface which can be easily replaced. Vibration from the coupled stator vane airfoils also partially cancels each other so that with the stator vane doublet, vibration transmitted to the joined platforms is reduced.

While the invention has been described in terms of various specific embodiments, those skilled in the art will recognize that the invention can be practiced with modification within the spirit and scope of the claims.

What is claimed is:

1. A method for assembling a gas turbine engine compressor including a stator assembly, said method comprising:

providing a compressor casing including at least two stator vane casing rails extending from the casing;

coupling a rail liner within each respective casing rail; and coupling a stator vane assembly including two dovetails, and at least two stator vanes coupled together within the casing rails within the liner such that a first dovetail is received within a first casing rail and a first rail liner, and a second dovetail is received within a second casing rail and a second rail liner.

2. A method in accordance with claim 1 further comprising coupling at least two stator vanes together at an outer platform of each stator vane to form the stator vane assembly.

3. A method in accordance with claim 2 wherein coupling at least two stator vanes together comprises brazing the stator vane platforms together.

4. A method in accordance with claim 2 wherein coupling at least two stator vanes together comprises:

nickel plating at least a portion of abutting surfaces of the platforms of each stator vane; and brazing the stator vane platforms together.

5. A method in accordance with claim 4 wherein brazing the stator vane platforms together comprises brazing the vane platforms using a gold-nickel braze alloy.

6. A method in accordance with claim 2 further comprising restoring metallurgical properties of the stator vane assembly after coupling the stator vane platforms together using a brazing operation.

7. A stator vane assembly for a gas turbine engine, said vane assembly comprising a plurality of circumferentially-spaced stator vane doublets, each said doublet comprising a pair of stator vanes coupled together at a respective outer stator vane platform of each said vane, each said stator vane platform includes two dovetails configured to slidably couple within at least two vane rails extending from a compressor casing that extends at least partially circumferentially around said stator vane assembly, said stator vane assembly further comprises at least two vane rail liners coupled within said at least two vane rails, said vane doublets configured to slidably couple within said vane rail liners.

8. A stator vane assembly in accordance with claim 7 wherein said pair of stator vanes are coupled together through a brazing operation.

9. A stator vane assembly in accordance with claim 7 wherein said pair of stator vanes are coupled together using a nickel braze.

10. A stator vane assembly in accordance with claim 7 wherein said pair of stator vane platforms define a portion of an outer flow path boundary through a compressor.

11. A stator vane assembly in accordance with claim 7 wherein said stator vane doublet is configured to facilitate reducing relative movement between said stator vane platforms and said at least two vane rails.

12. A compressor for a gas turbine engine, said compressor comprising:

a casing comprising a plurality of stator vane rails, said casing defining an axial flow path therethrough;

a rotor positioned within said flow path, said rotor comprising a plurality of rows of circumferentially-spaced rotor blades; and a stator vane assembly extending between adjacent rows of said plurality of rows of rotor blades, each said stator vane assembly comprising a plurality of circumferentially-spaced stator vane doublets including two dovetails received within at least two of said vane rails, each said stator vane doublet comprising a pair of stator vanes coupled together at a respective outer stator vane platform of each said vane.

13. A compressor in accordance with claim 12 further comprising at least two vane rail liners coupled within said at least two vane rails, each said vane platform is configured to slidably couple each said doublet within said vane rail liners.

14. A compressor in accordance with claim 12 wherein said stator vane doublet is configured to facilitate reducing relative movement between said vane platforms and said at least two vane rails.

15. A compressor in accordance with claim 12 wherein said stator vane platforms define a portion of an outer flow path boundary through said compressor, said stator vanes extend radially inward from said stator vane platform.

16. A compressor in accordance with claim 12 wherein said rotor defines a portion of an inner flow path boundary through said compressor.

17. A compressor in accordance with claim 12 wherein adjacent stator vane platforms define a bleed hole.

18. A stator vane assembly in accordance with claim 12 wherein said stator vane platforms are joined together by brazing.

* * * * *